US010337760B2

(12) United States Patent
Badenhorst

(10) Patent No.: US 10,337,760 B2
(45) Date of Patent: Jul. 2, 2019

(54) AIR DIFFUSER AND AN AIR CIRCULATION SYSTEM

(75) Inventor: Sean Michael Johl Badenhorst, Dulwich Hill (AU)

(73) Assignee: Kaip Pty Limited, Kingsgrove (AU)

( * ) Notice: Subject to any disclaimer, the term of this patent is extended or adjusted under 35 U.S.C. 154(b) by 809 days.

(21) Appl. No.: 13/643,034

(22) PCT Filed: Apr. 27, 2011

(86) PCT No.: PCT/AU2011/000436
§ 371 (c)(1),
(2), (4) Date: Jan. 7, 2013

(87) PCT Pub. No.: WO2011/130778
PCT Pub. Date: Oct. 27, 2011

(65) Prior Publication Data

US 2013/0137359 A1 May 30, 2013

(30) Foreign Application Priority Data

Apr. 23, 2010 (AU) ..... 2010901724

(51) Int. Cl.
*F24F 13/06* (2006.01)
*F24F 13/10* (2006.01)
(Continued)

(52) U.S. Cl.
CPC ..... *F24F 13/10* (2013.01); *F24F 13/06* (2013.01); *F24F 13/065* (2013.01); *F24F 13/26* (2013.01); *F24F 2221/14* (2013.01)

(58) Field of Classification Search
CPC ..... F24F 13/06; F24F 13/065; F24F 13/10; F24F 13/26; F24F 2221/14
(Continued)

(56) References Cited

U.S. PATENT DOCUMENTS 5,722,484 A * 3/1998 Subramanian ..... F24F 1/0011 165/122
5,888,133 A * 3/1999 Mori ..... F24F 1/0011 454/315
(Continued)

FOREIGN PATENT DOCUMENTS

GB 495312 11/1938
GB 2293447 A 3/1996
(Continued)

OTHER PUBLICATIONS

English Translation of JP2008232470.*
(Continued)

*Primary Examiner* — Steven B McAllister
*Assistant Examiner* — Allen R Schult
(74) *Attorney, Agent, or Firm* — Christensen O'Connor Johnson Kindness PLLC

(57) ABSTRACT

The present invention relates to an air diffuser. The air diffuser comprises at least one primary discharge element. The secondary discharge element is arranged to discharge a secondary airstream capable of flowing across at least one surface that directs the secondary airstream substantially in a plane of the diffuser discharge face in the vicinity directly downstream of the secondary discharge element. The primary discharge element is arranged to discharge a primary airstream that is induced by the secondary discharged airstream such that the direction of the primary discharged airstream is largely determined by the direction of travel of the secondary airstream.

20 Claims, 7 Drawing Sheets

Section B-B

Figure 1B:
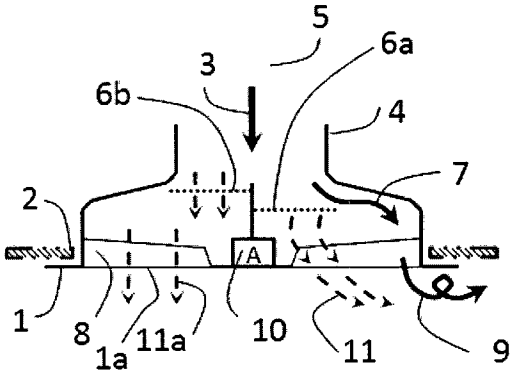

(51) Int. Cl.
*F24F 13/26* (2006.01)
*F24F 13/065* (2006.01)

(58) Field of Classification Search
USPC ..... 454/333
See application file for complete search history.

(56) References Cited

U.S. PATENT DOCUMENTS

| | | | | |
|---|---|---|---|---|
| 6,083,101 | A * | 7/2000 | Kaga | F24F 1/0011 165/122 |
| 6,582,293 | B1 * | 6/2003 | Siniarski | B60H 1/3414 454/155 |
| 2008/0254734 | A1 * | 10/2008 | Uenaka | F24F 1/0007 454/256 |
| 2010/0199697 | A1 * | 8/2010 | Sakashita | B01D 46/0065 62/259.1 |
| 2012/0214399 | A1 * | 8/2012 | Tsuji | F24F 1/0007 454/333 |
| 2014/0374075 | A1 * | 12/2014 | Michitsuji | F24F 1/0014 165/157 |

FOREIGN PATENT DOCUMENTS

| | | | |
|---|---|---|---|
| JP | 54-060663 | A | 5/1979 |
| JP | 5-203254 | A | 8/1993 |
| JP | 06-307711 | A | 11/1994 |
| JP | 11-118233 | A | 4/1999 |
| JP | 11118233 | A * | 4/1999 |
| JP | 2000-320192 | A | 11/2000 |
| JP | 2001-133029 | A | 5/2001 |
| JP | 2003-227648 | A | 8/2003 |
| JP | 2008-232470 | A | 10/2008 |
| JP | 2010-71499 | A | 4/2010 |
| JP | 2010-071499 | A | 4/2010 |
| JP | 2010071499 | A * | 4/2010 |
| WO | 02/42691 | A1 | 5/2002 |
| WO | 2008/119893 | A1 | 10/2008 |

OTHER PUBLICATIONS

First Office Action dated Aug. 5, 2014, in corresponding Chinese Application No. 201180028530.1, filed Apr. 27, 2011, 11 pages.
Patent Examination Report No. 1 dated Oct. 17, 2014, in corresponding Australian Application No. 2011242393, filed Apr. 27, 2011, 3 pages.
New Zealand Intellectual Property Office First Examination Report, dated Jun. 11, 2013, issued in corresponding New Zealand Patent Application No. 603730, filed Apr. 27, 2011, 2 pages.
International Search Report of the International Searching Authority dated Jun. 14, 2011, in corresponding International Patent Application No. PCT/AU2011/000436, filed Apr. 27, 2011, 3 pages.
Notice of Reasons for Rejection dated Nov. 21, 2014, in corresponding Japanese Application No. 2013-505276, filed Jun. 20, 2013, 8 pages.
Notice of Reasons for Rejection dated Sep. 29, 2015, issued in corresponding Japanese Application No. 2013-505276, filed Jun. 20, 2013, 8 pages.
Canadian Office Action dated Jul. 22, 2016, issued in corresponding Canadian Patent Application No. 2797196, filed Oct. 23, 2012, 3 pages.
Extended European Search Report dated Mar. 7, 2014, issued in corresponding Patent Application No. EP 11 771 390.9, filed Apr. 27, 2011, 6 pages.

* cited by examiner

Bottom View

AIR DIFFUSER AND AN AIR CIRCULATION SYSTEM

FIELD OF THE INVENTION

The present invention relates to an air diffuser. Embodiments of the invention find particular, but not exclusive, use as a ceiling swirl diffuser, a floor swirl diffuser or a linear slot diffuser, as part of an installed air delivery system.

BACKGROUND OF THE INVENTION

Many buildings have air conditioning or ventilation systems that distribute air throughout the building through ducts connected to diffusers. The diffusers distribute supply air into the spaces to be air conditioned or ventilated. Due to space constraints, such as ceiling grid dimensions into which diffusers may be required to fit, the maximum airflow rate per diffuser is often restricted to a less than optimum value, requiring the added expense of additional diffusers.

Many diffusers incorporate adjustable dampers or adjustable blades for airflow adjustment that provide a generally constant discharge velocity from the diffuser to maintain largely constant throw of the supply air into the occupancy space regardless of the damper or blade airflow setting. These adjustable dampers or blades may be regulated by means of thermally, electrically or pneumatically powered actuators, allowing a degree of individual occupancy space air temperature control to be achieved for the subzone served by that diffuser.

Adjustable blades are sometimes used to alter diffuser discharge direction—manually or by means of thermal, pneumatic or electric actuators. The airflow rate from such diffusers and the position of the diffuser dampers or blades is often affected by supply air pressure fluctuations in the supply duct system, e.g. due to the opening or closing of other dampers. This often results in poor temperature control of the subzones in question as the airflow rate discharged by each diffuser increases or decreases due to the increased or decreased supply air pressure, respectively, and due to further opening or closing of the diffuser's adjustable damper or adjustable blades caused by the elasticity of the damper/blade mechanism.

SUMMARY OF THE INVENTION

In accordance with a first aspect, the present invention provides an air diffuser comprising, at least one primary discharge element and at least one secondary discharge element, wherein:

the secondary discharge element is arranged to discharge a secondary airstream capable of flowing across at least one surface that directs the secondary airstream substantially in a plane of the diffuser discharge face in the vicinity directly downstream of the secondary discharge element; and the primary discharge element is arranged to discharge a primary airstream that is induced by the secondary discharged airstream such that the direction of the primary discharged airstream is largely determined by the direction of travel of the secondary airstream.

In one embodiment, the primary airstream has a substantially greater airflow rate than the secondary airstream.

The primary airstream when discharged in the absence of the secondary airstream may be substantially different to the discharge direction of the primary airstream when discharged in the presence of the secondary airstream.

In one embodiment, a secondary airflow rate element is manipulable to vary the airflow rate of the secondary airstream.

The discharge direction of the primary airstream may vary when the secondary airflow rate element is manipulated.

A primary airflow rate element may be manipulable to vary the airflow rate of the primary airstream.

In one embodiment, the air diffuser comprises a common airflow rate element that is manipulable to vary the airflow rates of the secondary airstream and of the primary airstream.

The common airflow rate element may vary the airflow rates of the primary airstream and of the secondary airstream substantially independently of one another.

In one embodiment, manipulation of the common airflow rate element reduces the airflow rate of the primary airstream without substantially varying the airflow rate of the secondary airstream.

Manipulation of the common airflow rate element may reduce the airflow rate of the secondary airstream without substantially varying the airflow rate of the primary airstream.

Manipulation of the common airflow rate element may reduce the airflow rate of the primary airstream without substantially varying the combined airflow rates of the primary airstream and of the secondary airstream.

Manipulation of the common airflow rate element may reduce the airflow rate of the secondary airstream without substantially varying the combined airflow rates of the primary airstream and of the secondary airstream.

In one embodiment, the primary discharge element is manipulable to alter the airflow rate of the primary airstream.

The primary discharge element may be manipulable to alter the airflow direction of the primary airstream.

The airflow rate discharged by the primary discharge element may remain largely constant, for a constant total supply air pressure, in the range of airflow direction adjustment.

In one embodiment, the secondary discharge element is manipulable to alter the airflow rate of the secondary airstream.

The secondary discharge element may be manipulable to alter the airflow direction of the secondary airstream.

The primary and secondary discharge elements may share a common vane, the manipulation of which varies the discharge direction of at least one of the primary and secondary airstreams.

Manipulation of the common vane may vary the discharge direction of the combined primary and secondary airstreams.

The combined airflow rate discharged by the primary and secondary discharge elements may remain largely constant, for a constant total supply air pressure, in the range of airflow direction adjustment.

The primary and secondary discharge elements may share a common vane, the manipulation of which varies the airflow rate of at least one of the primary and secondary airstreams.

Manipulation of the common vane may vary the airflow rate of the combined primary and secondary airstreams.

In one embodiment, deflection of the primary discharge element vane due to an increase or decrease in supply air pressure causes the primary discharge element aperture to be reduced or increased, respectively.

The primary and secondary discharge elements may share at least one common vane, deflection of which due to an increase or decrease in supply air pressure causes the apertures of the primary and the secondary discharge elements to be reduced or increased, respectively.

In another aspect, the air diffuser in accordance with a first aspect may be incorporated in a ducting system.

In a further aspect, the air diffuser in accordance with a first aspect may be incorporated in an air supply system.

DETAILED DESCRIPTION OF THE DRAWINGS

Figure 1A:
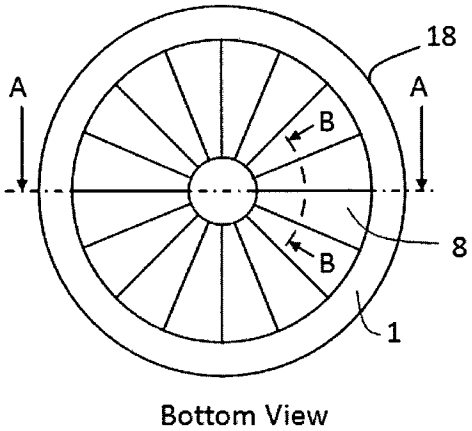
Figure 2B:
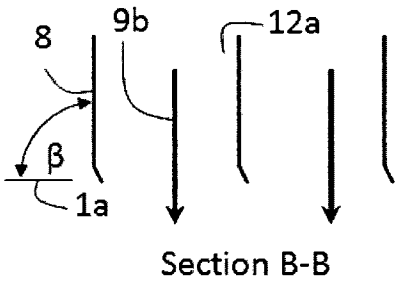
Figure 2A:
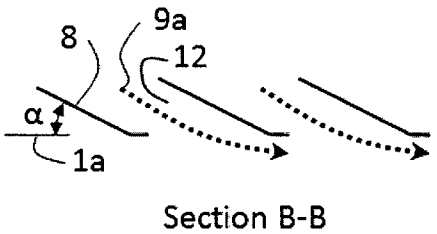
Figure 5B:
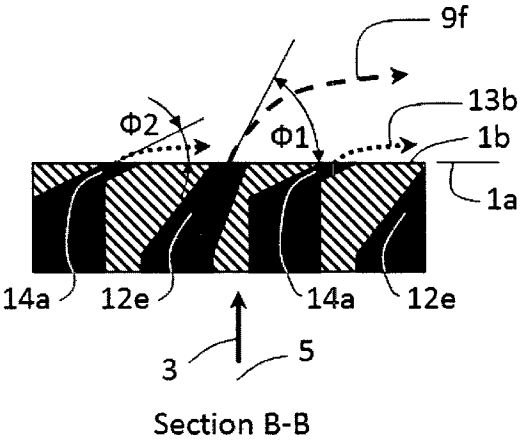
Figure 5A:
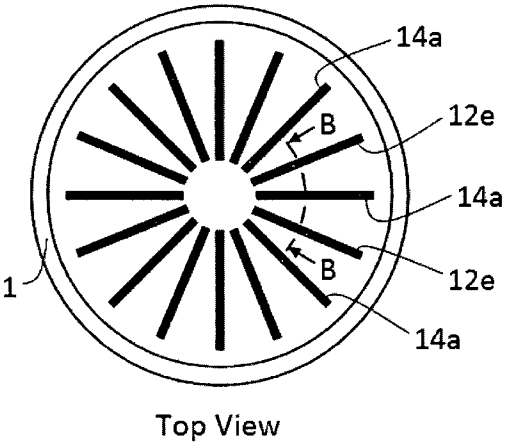

Notwithstanding any other forms that may fall within the scope of the present invention, preferred embodiments will now be described, by way of example only, with reference to the accompanying drawings in which:

FIGS. 1*a* and 1*b* are diagrams illustrating a typical ceiling swirl diffuser of the prior art;

FIGS. 2*a* and 2*b* are diagrams illustrating an adjustable discharge direction blade configuration of a prior art diffuser;

FIGS. 3*a* to 3*d* are diagrams illustrating an adjustable discharge direction and an adjustable airflow rate blade configuration of a diffuser in accordance with an embodiment of the invention;

FIGS. 4*a* to 4*d* are diagrams illustrating an adjustable discharge direction and an adjustable airflow rate damper configuration of a diffuser in accordance with an embodiment of the invention;

FIGS. 5*a* and 5*b* are diagrams illustrating a floor swirl diffuser with largely horizontal swirl discharge for displacement applications in accordance with an embodiment of the present invention; and FIGS. 6*a* to 6*e* are diagrams illustrating a linear slot diffuser with adjustable discharge direction, both of the prior art and as an embodiment of the invention.

DETAILED DESCRIPTION OF THE PREFERRED EMBODIMENTS

By way of introducing embodiments of the present invention, aspects relating to diffusers are firstly mentioned.

Ceiling diffusers in buildings are usually designed to discharge air horizontally above head height, with a throw that largely covers the footprint of the space to be dealt with by each diffuser, as reduced throw (i.e. under-throw) increases the threat of dumping in cooling mode, thereby creating draughts and poor temperature distribution in the occupancy space. Conversely, increased throw (i.e. over-throw) increases' the threat of air streams clashing with one another or with obstructions, such as walls, thereby increasing the threat of draughts.

In spaces requiring heating from ceiling diffusers, especially if ceilings are high, diffusers with a largely downward discharge direction are often selected so as to compensate for the buoyancy of the hot supply air, thereby improving the penetration of warm supply air into the low level occupancy zone.

Ceiling swirl diffusers are increasingly being used in preference to four-way blow diffusers or other low induction air diffusion equipment for both of aforementioned applications, as their highly inductive discharge draws in and mixes large quantities of room air into the discharged supply air stream, thereby rapidly breaking down the supply-to-room temperature differential to provide more uniform temperature distribution throughout the occupancy space whilst simultaneously bringing about rapid discharge velocity decay, which enhances draught-free comfort.

In order to reduce fan energy during off-peak loads, variable speed supply air fans or variable air volume (VAV) supply air systems are often used to supply conditioned air to the diffusers, especially in cooling mode. Such systems, though, are often not used at reduced airflow rates in heating mode, especially for supply air discharge from high ceilings, as reduced discharge velocity from each diffuser reduces the momentum of the warm and buoyant supply air being discharged down into the occupancy space, thereby reducing supply air penetration to the occupants, impairing heating efficiency.

To deal with variable air flow rates in cooling mode the diffusers need to provide stable horizontal discharge with relatively constant horizontal throws of the low temperature supply air, at both high and low airflow rates. For diffusers that have fixed horizontal discharge, high airflow rates generally increase throw, often producing over-throw, which may cause draughts where air streams from adjacent diffusers clash or where air streams hit obstructions such as walls or bulkheads; low airflow rates generally reduce throw, often causing zones of stagnation and of increased air temperature beyond the throw of the diffuser whilst cold spots or even draughts may occur close to or beneath the diffuser due to dumping of cold, dense supply air into the occupancy space. In such variable air volume applications standard horizontal discharge ceiling swirl diffusers with fixed horizontal discharge perform substantially better, both in terms of efficiency and perceived comfort, than horizontal discharge four-way blow diffusers, due to the higher induction ratios and better mixing of supply and room air provided by the former, but even so, a turndown ratio to approximately 30 to 40 percent is usually the lower limit of the former in cooling mode, especially if the supply-to-room temperature differential is high (often as high as 16 K); and heating effectiveness of the former is only slightly improved due to the increased mixing, but it is nevertheless poor due to the horizontal discharge direction of such standard horizontal discharge swirl diffusers.

Adjustable dampers, arranged to maintain a largely constant supply air stream velocity onto a portion of the swirl vanes, are sometimes used directly upstream of the diffuser so as to decrease the minimum permissible diffuser airflow rate. Such dampers are often motorised for VAV applications, and hence extend the VAV range of the diffuser, however they typically blank off a portion of the swirl blades even at the maximum airflow setting, thereby necessitating the need for oversized diffusers, and they tend to generate noise due to the increased air stream velocity onto the active portion of the swirl blades.

Swirl diffusers with adjustable discharge direction (usually achieved by altering the diffuser blade angle, or by adjustable guide vanes or jets of air that may be activated to deflect or induce the supply air stream downwards) are often used to improve heating efficiency by directing the warm supply air downwards. Such diffusers often incorporate thermally powered or electric or pneumatic actuators that automatically adjust discharge direction as a function of the supply air temperature or the supply-to-room air temperature differential. Adjustable blade angle tends to offer the best heating penetration to a low level, but cooling performance is compromised due to the extremely flat blade angle required to discharge air horizontally, as this, in turn, restricts the aperture between diffuser blades. Indeed, relatively flat blade angles are required for all of the swirl diffusers of the prior art in cooling mode; they, therefore, have to be selected with relatively large diffuser face sizes in relation to the airflow rate to be discharged, negatively impacting space requirements, costs and aesthetics.

General Overview

The embodiments, as described herein, relate generally to an air diffuser assembly for ceiling discharge with an air supply supplied from a pressure plenum or duct.

FIG. 1*a* is a diagram illustrating the bottom view, and FIG. 1*b* the side section view of a typical ceiling swirl diffuser (18) of the prior art, in which a face flange (1) that abuts ceiling or duct penetration (2) may be included in the diffuser discharge face plane (1*a*), and in which supply airstream (3) flows into diffuser inlet (4) from duct or supply plenum (5). An optional diffuser damper, shown fully open (6*a*) and fully closed (6*b*), may be used to manually adjust the airflow rate to the diffuser. The airflow rate of airstream (3) to the diffuser may, additionally, be automatically varied by means of a variable speed drive fan, motorised damper or similar located upstream of diffuser inlet (4). Such airflow rate adjustment of supply air stream (3) causes both the airflow rate and the velocity of damper airstream (7) onto swirl vanes (8) to increase or decrease simultaneously, bringing about strong changes to the throw of discharged swirl airstream (9) into the occupancy space, as throw is a function of airflow rate multiplied by discharge velocity. Such changes in the throw of swirl airstream (9) compromise comfort, as over-throw increases the threat of draughts, and under-throw that of stagnation. Moreover, due to the extremely low momentum of discharged swirl airstream (9) at low airflow rates, the minimum airflow rate is typically limited to approximately 30% and 40% of the maximum airflow rate so as to prevent the cold and dense supply air from dumping into the occupancy space when supply airstream airflow rate (3), is turned down.

In order to reduce the throw sensitivity of discharged swirl airstream (9) to changes in supply airstream airflow rate (3), in order to reduce the threat of swirl airstream (9) from dumping at low airflow rates, and as a means of incorporating independent variable air volume (VAV) adjustability into individual diffusers, diffusers of the prior art may adjust supply airstream airflow rate (3) via electrically, pneumatically or thermally powered actuator (10), to open (6*a*) and close (6*b*) a diffuser damper mechanism in the diffuser that varies the airflow rate, at a largely constant velocity, of damper airstream (7) onto largely radial swirl blades (8), thereby discharging swirl airstream (9) of varying volume flow rate at largely constant discharge velocity over a large portion of the turndown range. However, the high velocity of damper airstream (7) onto the active portion of swirl blades (8) may cause excessive regenerated noise from the diffuser. Moreover, diffuser damper (6*a* and 6*b*) blanks off airflow to that portion of swirl blades (8) directly beneath the damper, thereby reducing the maximum permissible airflow rate of the diffuser. This is sometimes partially compensated for by perforating the diffuser damper (6*a* and 6*b*) to allow low momentum supply air (11) to flow through the otherwise largely inactive portion of swirl blades (8), to be induced by the higher momentum discharged swirl airstream (9). However, this only partially compensates for the reduction in diffuser maximum permissible airflow rate and, indeed, may increase the threat of dumping (11*a*) as the diffuser damper approaches the closed position (6*b*), given that the airflow rate and, momentum of discharged swirl airstream (9) diminish as the diffuser damper is adjusted from position (6*a*) to (6*b*). A further problem with the damper arrangement integrated into the diffuser of the prior art, as shown in FIG. 1*b*, is that the diffuser damper opens (6*a*) and closes (6*b*) by moving downstream and upstream, respectively. Consequently, if the diffuser pressure drop decreases (as described in FIG. 2 below) or if air pressure in supply duct or plenum (5) increases (e.g. due to other diffusers in the supply duct system shutting off), not only does damper airflow rate (7) increase due to the increase in supply air pressure, but it also increases due to an increase in the diffuser damper aperture through which damper airstream (7) is discharged, caused by the elasticity and play of the diffuser damper and associated actuator (10) mechanism. Consequently, the diffuser damper (6*a* and 6*b*) is pushed further open by the increase in supply air pressure. Changes in air pressure in supply duct or plenum (5), therefore, may cause strong uncontrolled increases and decreases in discharged swirl airflow rate (9), thereby compromising thermostatic temperature control and thermal comfort in the occupancy space. A diffuser damper (6*a* and 6*b*) operated by an actuator (10) that is thermally powered may be especially susceptible to such uncontrolled pressure induced aperture adjustment due to a variety of factors, such as the extremely sensitive mechanism required to deal with the short and relatively weak operating stroke of the actuator, the actuator's high hysteresis, and the sluggishness that the actuator's high thermal inertia causes to the control response.

FIG. 2 is a diagram illustrating side section views of the swirl blades (8) of a typical ceiling swirl diffuser of the prior art, as shown in FIG. 1*a*, in which FIG. 2*a* shows the relatively flat blade angle ($\alpha$) to the diffuser discharge face plane (1*a*) required to achieve largely parallel discharge of swirl airstream (9*a*) relative to the diffuser discharge face plane (1*a*), as is generally required of a ceiling swirl diffuser operating in cooling mode. Shallow blade angle ($\alpha$) reduces the swirl slot aperture (12) between adjacent swirl blades (8), thereby, restricting the airflow rate of discharged swirl airstream (9*a*). FIG. 2*b* shows a further embodiment of a typical ceiling swirl diffuser of the prior art, in this instance with adjustable blades, in which swirl blades (8) may be swivelled, manually or by means of at least one thermally, pneumatically or electrically powered actuator (not shown), to a steep angle ($\beta$) relative to the diffuser discharge face plane (1*a*), in which ($\beta$)>($\alpha$), to alter the discharge direction of swirl airstream (9*b*) to be largely perpendicular to the diffuser discharge face plane (1*a*), as may be required of a ceiling swirl diffuser operating in heating mode, especially if the discharge height is high. Steep blade angle ($\beta$) increases the swirl slot aperture (12*a*) between adjacent swirl blades (8), thereby, for a largely constant total supply air pressure, increasing the airflow rate of discharged airstream (9*b*) relative to that of (9*a*). Changes to the angle of diffuser swirl blades (8) may, therefore, cause strong uncontrolled increases or decreases in discharged swirl airflow rate (9*b* and 9*a*), thereby compromising thermostatic temperature control and thermal comfort in the occupancy space served by that diffuser; these uncontrolled changes in supply airflow rate changes cannot be fully offset by additionally equipping the diffuser with adjustable diffuser damper (6*a* and 6*b* in FIG. 1) driven by thermally, electrically or pneumatically powered actuator (10 in FIG. 1), for the reasons described in FIG. 1. Moreover, the change in the airflow rate of the discharged swirl airstream (9*a* and 9*b*) may cause supply airstream static pressure to the diffuser, and hence to the entire supply air system including other diffusers in that system, to change, thereby compromising thermostatic temperature control and thermal comfort produced by the entire system, including in other thermal zones, especially if such zones are served by diffusers with airflow rate adjustment by means of diffuser dampers (6*a* and 6*b*) that are thermally powered.

Figure 3A:
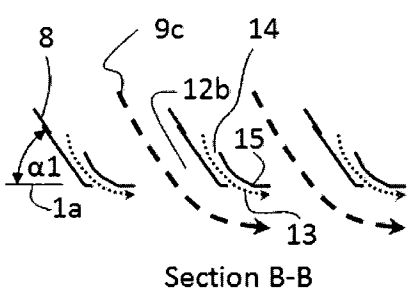
Figure 3B:
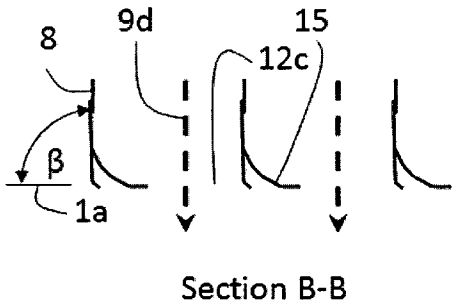
Figure 3C:
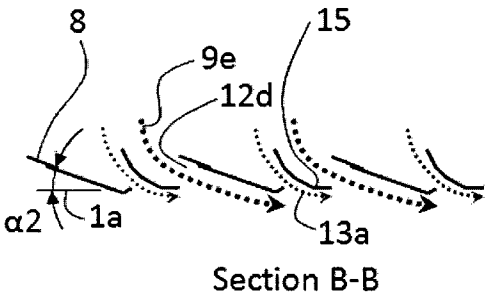
Figure 3D:
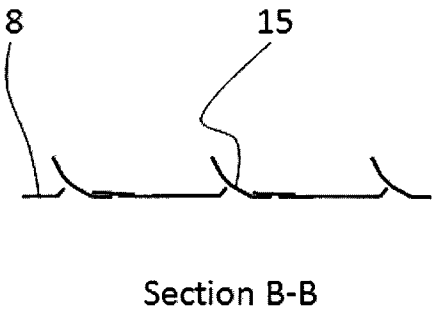

FIG. 3 is a diagram illustrating side section views of the swirl blades (8) of a ceiling swirl diffuser in accordance with an embodiment of the invention, in which FIG. 3*a* shows the increased swirl airflow rate (9*c*) in comparison to that of the prior art (9*a* in FIG. 2*a*), achieved by increasing the aperture of swirl slot (12*b*) between swirl blades (8) as a result of the relatively steep blade angle (α1) to the diffuser discharge face plane (1*a*), whereby (α1)>(α in FIG. 2*a*). Guide slot airstream (13), which may have a substantially smaller airflow rate than swirl airstream (9*c*), is discharged through guide slot (14) and attaches itself to guide vane (15) to be directed largely parallel to diffuser discharge face plane (1*a*) directly downstream of the diffuser. Discharged swirl airstream (9*c*) is redirected to a largely parallel direction relative to the diffuser discharge face plane (1*a*) by the induction of guide slot airstream (13), creating, relative to the diffuser discharge face plane (1*a*), a largely parallel movement away from the diffuser of the combined airstreams (9*c* and 13) directly downstream of the diffuser. FIG. 3*b* shows a further embodiment of the invention in which swirl blades (8) may be swivelled, manually or by means of at least one thermally, pneumatically or electrically powered actuator (not shown), to a steep angle (β) relative to the plane of diffuser discharge face (1*a*), in which (β)>(α1), to largely close off guide slot (14), thereby shutting off slot airstream, (13), and to alter the discharge direction of discharged swirl airstream (9*d*) to be largely perpendicular to the diffuser discharge face plane (1*a*). Since the increase in the angle of swirl blade (8) from (α1) to (β) is small in comparison to that from (α) to (β) of the prior art, the increase in the aperture of swirl slot (12*b*) to (12*c*) and the resultant increase in the discharge swirl airflow rate from (9*c*) to (9*d*) are small. Moreover, these increases are compensated for by largely corresponding decreases in the aperture of guide slot (14) and the resultant airflow rate of guide slot airstream (13), producing in a largely constant combined airflow rate discharged by the diffuser when operating at a largely constant supply airstream total pressure, regardless of the angle of swirl blades (8) in the range (α1) to (β). FIG. 3*c* shows a further embodiment of the invention in which swirl blades (8) may be swivelled, manually or by means of at least one thermally, pneumatically or electrically powered actuator (not shown), to a shallow angle (α2) relative to the diffuser discharge face plane (1*a*), in which (α2)<(α1), to throttle both swirl airstream (9*e*) and guide slot airstream (13*a*) whilst maintaining largely constant discharge velocity of both airstreams and whilst maintaining a largely parallel movement away from the diffuser of the combined airstreams directly downstream of the diffuser relative to the diffuser discharge face plane (1*a*). FIG. 3*d* shows swirl blades (8) swivelled to largely shut off airflow from the diffuser.

Figure 4A:
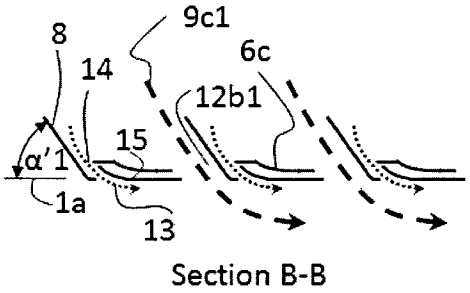
Figure 4B:
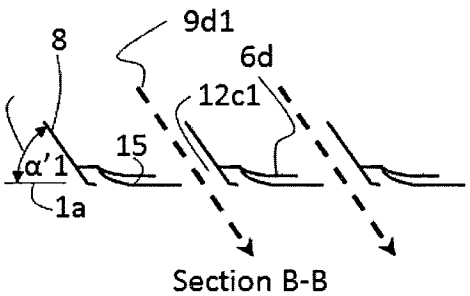
Figure 4C:
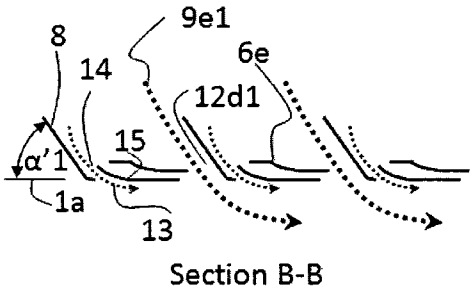
Figure 4D:
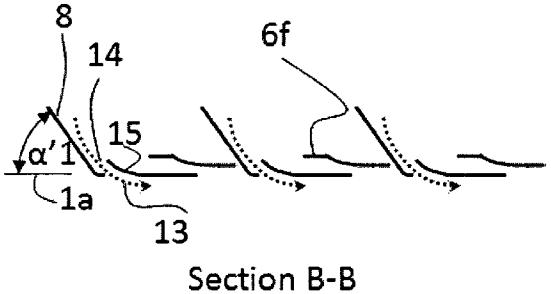

FIG. 4 is a diagram illustrating side section views of the swirl blades (8) of a ceiling swirl diffuser in accordance with an embodiment of the invention, in which FIG. 4*a* shows the increased blade angle (α'1) to the diffuser discharge face plane (1*a*), whereby (α'1)>(α in FIG. 2*a*). Diffuser damper (6*c*) is in the fully open position, maximising the apertures of guide slot (14) and swirl slot (12*b*1). Guide slot airstream (13), which may have a substantially smaller airflow rate than swirl airstream (9*c*1), is discharged through guide slot (14) and attaches itself to guide vane (15) to be directed largely parallel to diffuser discharge face plane (1*a*) directly downstream of the diffuser. Discharged swirl airstream (9*c*1) is redirected to a largely parallel direction relative to the diffuser discharge face plane (1*a*) by the induction of guide slot airstream (13), creating, relative to the diffuser discharge face plane (1*a*), a largely parallel movement away from the diffuser of the combined airstreams (9*c*1 and 13) directly downstream of the diffuser. FIG. 4*b* shows a further embodiment of the invention in which diffuser damper (6*d*), has been slid, manually or by means of at least one thermally, pneumatically or electrically powered actuator (not shown), to largely close off guide slot (14), thereby largely shutting off guide slot airstream (13), so as to alter the discharge direction of discharged swirl airstream (9*d*1) to be largely directed away from the diffuser discharge face plane (1*a*). FIG. 4*c* shows a further embodiment of the invention in which diffuser damper (6*e*) may be slid, manually or by means of at least one thermally, pneumatically or electrically powered actuator (not shown), to partially close the aperture of swirl slot (12*d*1), so as to throttle swirl airstream (9*e*1) whilst maintaining largely constant discharge velocity and whilst maintaining a largely parallel movement away from the diffuser of the combined swirl (9*e*1) and guide slot (13) airstreams directly downstream of the diffuser relative to the diffuser discharge face plane (1*a*). FIG. 4*d* shows diffuser damper (6*f*) slid to largely shut off airflow from the diffuser whilst maintaining a largely parallel movement away from the diffuser of the guide slot airstream (13) directly downstream of the diffuser relative to the diffuser discharge face plane (1*a*).

FIGS. 5*a* and 5*b* are diagrams illustrating a top view and a section of a floor swirl diffuser in accordance with an embodiment of the invention, in which swirl slot (12*e*), which discharges swirl air stream (9*f*), alternates with guide slot (14*a*), which discharges guide slot air stream (13*b*). Swirl airstream (9*f*) is discharged at a relatively steep angle (Φ1) to the diffuser discharge face plane (1*a*). Guide slot airstream (13*b*), which may have a substantially smaller airflow rate than swirl airstream (9*f*), is discharged at a shallow angle (Φ2) to the diffuser discharge face plane (1*a*), in which (Φ2)<(Φ1), so as to attach itself to the diffuser face (1*b*) to be directed largely parallel to diffuser discharge face plane (1*a*) directly downstream of the diffuser. Discharged swirl airstream (9*f*) is redirected to a largely parallel direction relative to the diffuser discharge face plane (1*a*) by the induction of discharged guide slot airstream (13*b*), creating, relative to the diffuser discharge face plane (1*a*), a largely parallel movement away from the diffuser of the combined airstreams (9*f* and 13*b*) directly downstream of the diffuser. The total floor swirl diffuser airflow rate discharged by this embodiment of the invention may be greater than that of a comparable floor swirl diffuser (i.e. of similar face size, slot length, slot width, number of slots and operating pressure) that produces discharge parallel to the diffuser discharge face plane but without alternating slot discharge angles.

Figure 6A:
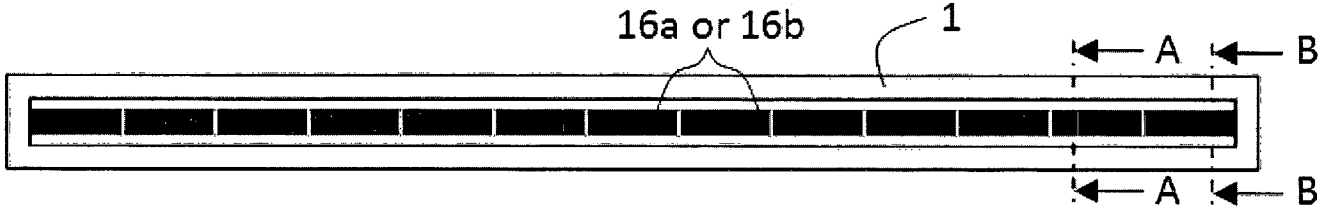
Figure 6C:
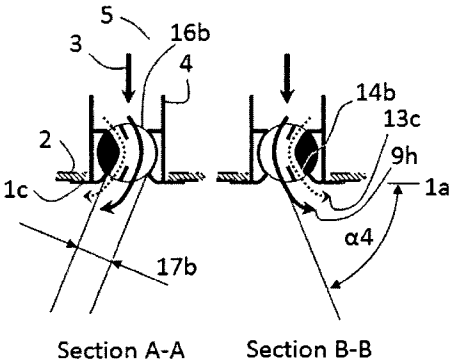
Figure 6B:
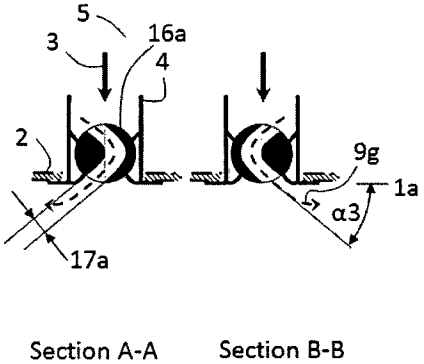
Figure 6E:
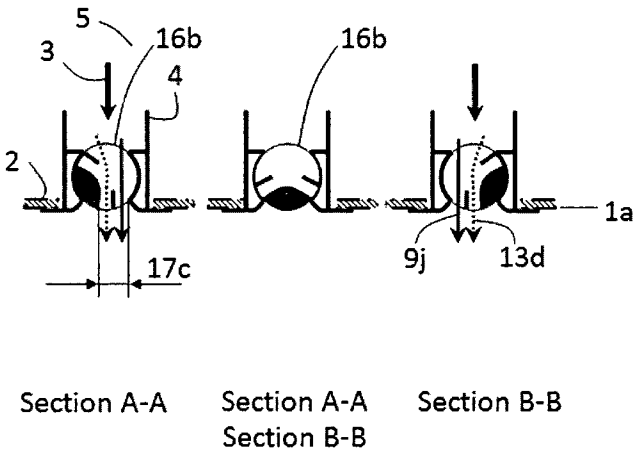
Figure 6D:
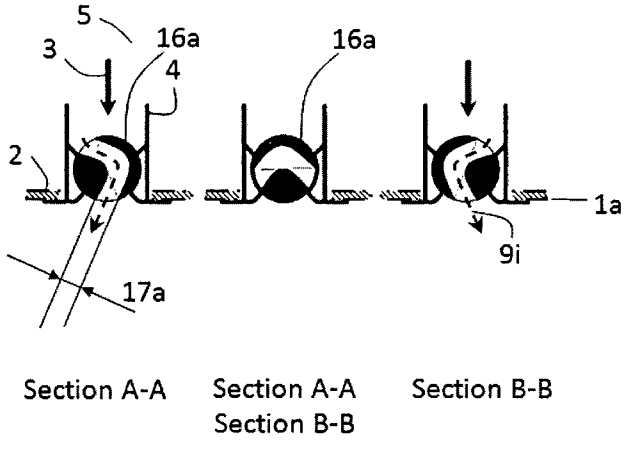

FIG. 6*a* is a diagram illustrating the bottom view of a linear slot diffuser, as it would appear in some embodiments both of the prior art and of the invention. A multitude of slotted barrels (16*a* or 16*b*) in the linear slot diffuser may have alternating discharge direction as shown in FIG. 6*b*, which illustrates an embodiment of the prior art, and in FIG. 6*c*, which illustrates an embodiment of the invention, in which the latter shows the increased airflow rate in comparison to that of the former by virtue of the increased discharge angle (α4>α3) of the primary air stream (9*h* relative to 9*g*) which results in reduced resistance, as well as due to the potential to increase the overall slot width (17*b*>17*a*): Guide slot airstream (13*c*), which may have a substantially smaller airflow rate than primary airstream (9*h*), is discharged through guide slot (14*b*) and attaches itself to diffuser face flange (1*c*) to be directed largely parallel to diffuser discharge face plane (1*a*) directly downstream of the diffuser. Discharged primary airstream (9*h*) is redirected to a largely parallel direction relative to the diffuser discharge face plane (1*a*) by the induction of guide slot airstream (13*c*), creating, relative to the diffuser discharge face plane (1*a*), a largely parallel movement away from the diffuser of the combined airstreams (9*h* and 13*c*) directly downstream of the diffuser. FIG. 6*d* shows embodiments of the prior art in which the left and right illustrations depict the diffuser discharge direction adjusted largely downwards, which may be achieved by turning the barrels (16*a*) to direct supply air largely downwards; the middle figure shows barrels (16*a*) turned to shut off supply airflow. FIG. 6*e* shows a further embodiment of the invention in which the left and right illustrations depict barrels (16*b*) turned to direct supply air largely downwards; the middle figure shows barrels (16*b*) turned to shut off supply airflow. When discharging supply air largely downwards, the embodiment illustrated in FIG. 6*e* may have increased airflow rate in comparison to the downward discharge embodiment of the prior art illustrated in FIG. 6*d*, by virtue of the reduced resistance to the airflow within the barrel (16*b* vs 16*a*), as well as due to the potential to increase the overall slot width (17*c*>17*a*).

For reasons of simplicity, the illustrations above show neither embodiments of the invention incorporating more than one guide slot for each opening or slot that discharges a swirl air stream or primary air stream, nor embodiments of the invention incorporating more than one opening or slot discharging a swirl or primary airstream for each guide slot that discharges a guide air stream.

For reasons of simplicity, the illustrations above show the discharge openings largely coincident with a plane that is largely coincident with the diffuser discharge plane. It will be appreciated by persons skilled in the art that the discharge openings need not be coincident with a plane (for example, they may lie on a curved surface) and that they need not be coincident with the diffuser discharge plane (which, for example, may be a perforated plate further downstream).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

Advantageous Features of the Embodiments Described Herein

An air delivery system incorporating the diffuser described herein provides the potential for substantial energy savings and more effective performance, as well as for improved thermal comfort, reduced capital cost and enhanced aesthetics.

HVAC systems that deliver supply air to spaces via diffusers with guide slots in accordance with the invention may be designed to operate with variable speed drive fans or may incorporate devices, such as variable air volume (VAV) boxes, to reduce airflow during periods of low thermal load, thereby saving fan energy, as a diffuser as described by these embodiments of the invention, when configured to discharge air largely horizontally, can have the supply air turned down to a far lower airflow rate, whilst maintaining stable and largely horizontal discharge, than is possible with comparable diffusers of the prior art. Moreover, this is generally achieved without requiring an increase in operating pressure. This provides substantial potential for increased fan energy savings. Additionally, the maximum airflow rate that may be discharged by a diffuser as described by some embodiments of the invention is greater than that of a comparable diffuser of the prior art, thereby potentially allowing a smaller number of diffusers to be used, or a smaller diffuser face size to be selected, hence reducing capital costs and improving aesthetics. Embodiments of the invention allow the diffuser to provide variable geometry airflow rate and discharge direction adjustment that improves occupancy zone air temperature control, increases heating efficiency, and reduces uncontrolled airflow rate fluctuations due to system supply air pressure changes, thereby improving both occupant comfort and system efficiency.

The claims defining the invention are as follows:

1. A swirl air diffuser, comprising:

a plurality of substantially radially extending swirl blades, the swirl blades defining at least one set of diffuser openings having a primary opening and a secondary opening, each set having:

a primary discharge element positioned upstream of the primary opening; and a secondary discharge element positioned upstream of the secondary opening, wherein, for each set of diffuser openings:

the secondary discharge element is arranged to discharge a secondary airstream through the secondary opening of the diffuser and along at least one surface substantially in a plane of a diffuser discharge face, the surface being downstream of the secondary discharge element;

the primary discharge element is adjustable between:

a first position, whereby the primary discharge element is positioned to discharge the primary airstream through the primary opening, wherein the primary airstream is induced by the secondary discharged airstream such that the direction of the primary discharged airstream is influenced by the direction of travel of the secondary airstream; and a second position, whereby the primary discharge element is positioned such that the secondary air stream is substantially shut off and the primary airstream is discharged in a direction that is substantially different to the discharge direction of the primary airstream when the primary discharge element is in the first position; and wherein the secondary discharge element is fixed so as to remain in the same position when the primary discharge element is adjusted between the first and second positions, and the primary opening is wider than the secondary opening when the primary discharge element is in the first position.

2. A swirl air diffuser in accordance with claim 1, wherein the primary airstream has a substantially greater airflow rate than the secondary airstream.

3. A swirl air diffuser in accordance with claim 1, wherein the discharge direction of the primary airstream when discharged in the absence of the secondary airstream is substantially perpendicular to the plane of the diffuser face.

4. A swirl air diffuser in accordance with claim 1, wherein the primary discharge element is manipulable to alter the airflow rate of the primary airstream.

5. A swirl air diffuser in accordance with claim 1, wherein the primary discharge element is manipulable to alter the airflow direction of the primary airstream.

6. A swirl air diffuser in accordance with claim 5, wherein the combined airflow rate of the primary and secondary airstreams discharged by the primary and secondary discharge elements remains constant, for a constant total supply air pressure, in the range of airflow direction adjustment.

7. A swirl air diffuser in accordance with claim 1, wherein the primary discharge element is manipulable to alter the airflow rate of the secondary airstream.

8. A swirl air diffuser in accordance with claim 1, wherein deflection of the primary discharge element due to an increase or decrease in supply air pressure causes the primary opening to be reduced or increased, respectively.

9. A ducting system incorporating at least one swirl air diffuser in accordance with claim 1.

10. An air supply system incorporating at least one swirl air diffuser in accordance with claim 1.

11. A swirl air diffuser in accordance with claim 4, wherein the primary discharge element is manipulable by being swivelled manually.

12. A swirl air diffuser in accordance with claim 4, wherein the primary discharge element is manipulable by being swivelled by a powered actuator chosen from the group comprising thermal, pneumatic, and electric powered actuators.

13. A swirl air diffuser in accordance with claim 5, wherein the primary discharge element is manipulable by being swivelled manually.

14. A swirl air diffuser in accordance with claim 5, wherein the primary discharge element is manipulable by being swivelled by a powered actuator chosen from the group comprising thermal, pneumatic, and electric powered actuators.

15. A swirl air diffuser in accordance with claim 1, wherein the primary and secondary discharge elements are respective swirl blades.

16. A swirl air diffuser in accordance with claim 1, wherein, when operating at a constant pressure, a combined volumetric airflow rate of the primary and secondary airstreams in the first position is substantially the same as a volumetric airflow rate of the primary airstream in the second position.

17. A swirl air diffuser in accordance with claim 1, wherein the primary discharge element is adjustable between the first position and a third position to reduce the volumetric airflow rate of the primary airstream without substantially changing the airflow direction of a combined airflow stream of the primary and secondary airstreams.

18. A swirl air diffuser in accordance with claim 1, wherein the primary discharge element is manipulable to alter a combined volumetric airflow rate of the primary and secondary airstreams over a volumetric airflow rate range in which the discharge direction of the primary airstream is substantially along a plane parallel to the diffuser face.

19. A swirl air diffuser in accordance with claim 7, wherein a first angle of the primary discharge element relative to the plane of the diffuser face is less than a second angle of the primary discharge element relative to the plane of the diffuser face, wherein the first angle is in a first volumetric airflow rate range where the primary discharge element is positioned for airflow rate adjustment of the combined airflow rate of the primary and secondary airstreams, and wherein the second angle is in a second volumetric airflow rate range where the primary discharge element is positioned for airflow direction adjustment of the primary airstream.

20. A swirl air diffuser in accordance with claim 5, wherein the primary discharge element is manipulable to alter the airflow rate of the secondary airstream.

* * * * *